US011992045B2

(12) United States Patent
Qiu et al.

(10) Patent No.: US 11,992,045 B2
(45) Date of Patent: May 28, 2024

(54) ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Shaopeng Li, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 680 days.

(21) Appl. No.: 17/151,224

(22) Filed: Jan. 18, 2021

(65) Prior Publication Data

US 2021/0137165 A1 May 13, 2021

Related U.S. Application Data

(63) Continuation-in-part of application No. PCT/CN2019/094199, filed on Jul. 1, 2019.

(30) Foreign Application Priority Data

Jul. 16, 2018 (CN) ..... 201821129866.2

(51) Int. Cl.
*A24F 40/42* (2020.01)
*A24F 40/10* (2020.01)
*A24F 40/51* (2020.01)

(52) U.S. Cl.
CPC ..... *A24F 40/42* (2020.01); *A24F 40/10* (2020.01); *A24F 40/51* (2020.01)

(58) Field of Classification Search
CPC ..... A24F 40/42; A24F 40/10; A24F 40/51; A24F 40/485
(Continued)

(56) References Cited

U.S. PATENT DOCUMENTS 10,010,109 B2 * 7/2018 Janardhan ..... A24F 40/40
11,439,183 B2 * 9/2022 Woodcock ..... G08B 21/182
(Continued)

FOREIGN PATENT DOCUMENTS

CN 205962841 U 2/2017
CN 206354425 U 7/2017
(Continued)

OTHER PUBLICATIONS

The extended European search report of EP application No. 19838718.5 issued on Mar. 11, 2022.

*Primary Examiner* — Alexander Gilman
(74) *Attorney, Agent, or Firm* — Andrew C. Cheng

(57) ABSTRACT

An electronic cigarette includes an atomizer, a power supply device detachably connected to the atomizer, and a sensor; the atomizer is provided with a first induction air passage and a first communication hole communicating with the first induction air passage; the power supply device is provided with a second induction air passage and a second communication hole communicating with the second induction air passage; the quantity of either the first communication hole or the second communication hole is set to be at least one, and the quantity of the other one is set to be at least two. When the atomizer is connected at different angles with respect to the power supply device, at least one of the first communication holes is in communication with at least one of the second communication holes, such that the first induction air passage is in communication with the second induction air passage.

14 Claims, 8 Drawing Sheets

(58) Field of Classification Search
USPC ..... 131/328
See application file for complete search history.

(56) References Cited

U.S. PATENT DOCUMENTS

| | | | | |
|---|---|---|---|---|
| 2016/0095356 | A1* | 4/2016 | Chan | A24F 40/30 392/390 |
| 2016/0235121 | A1* | 8/2016 | Rogan | H05B 1/0227 |
| 2017/0006920 | A1* | 1/2017 | Liu | A24F 40/50 |
| 2017/0135399 | A1* | 5/2017 | Gavrielov | H05B 3/06 |
| 2017/0231282 | A1* | 8/2017 | Bowen | A61M 11/042 131/329 |
| 2017/0251727 | A1* | 9/2017 | Nielsen | A24F 40/40 |
| 2018/0020721 | A1* | 1/2018 | Garthaffner | H05B 3/44 392/404 |
| 2018/0043114 | A1* | 2/2018 | Bowen | A61M 15/003 |
| 2018/0092404 | A1* | 4/2018 | Servutas | A24F 40/485 |
| 2018/0177233 | A1* | 6/2018 | Tucker | A24F 40/40 |
| 2018/0184717 | A1* | 7/2018 | Jiang | A24F 40/485 |
| 2018/0192700 | A1* | 7/2018 | Fraser | A24F 40/44 |
| 2018/0192704 | A1* | 7/2018 | Hawes | G06F 21/44 |

FOREIGN PATENT DOCUMENTS

| | | | |
|---|---|---|---|
| CN | 206744576 | U | 12/2017 |
| CN | 206744580 | U | 12/2017 |
| CN | 107692323 | A | 2/2018 |
| CN | 207531901 | U | 6/2018 |
| CN | 208692313 | U | 4/2019 |
| KR | 20160112770 | A | 9/2016 |
| WO | 2015018026 | A1 | 2/2015 |

* cited by examiner

ELECTRONIC CIGARETTE

CROSS-REFERENCE TO RELATED APPLICATIONS

The present application is a continuation-in-part of international application No. PCT/CN2019/094199 filed on Jul. 1, 2019, and claims priority to Chinese patent application No. 201821129866.2 filed on Jul. 16, 2018, and the entire disclosures of the foregoing applications are incorporated herein by reference.

FIELD OF TECHNOLOGY

The disclosure relates to the technical field of smoking simulation, and more particularly, relates to an electronic cigarette.

BACKGROUND

The existing electronic cigarette includes an atomizer and a power supply device electrically connected to the atomizer. During operation, the atomizer is electrically driven by the power supply device to atomize the cigarette liquid to generate smoke for the user to inhale. In order to realize the function that the power supply device can automatically supply power to the atomizer during the user's suction operation, the atomizer is provided with a first induction air passage, the power supply device is provided with a second induction air passage, and the power supply device is equipped with a sensor. The sensor is in communication with the second induction air passage. When the atomizer is connected to the power supply device, the first induction air passage is in communication with the second induction air passage. When the user performs a suction operation, the power supply device detects the change in the air pressure sensed by the sensor, then the atomizer is powered.

However, there is usually only one for each of the first induction air passage and the second induction air passage in quantity, which makes the connection angle of the atomizer relative to the power supply device relatively fixed, and the user can only connect the two at a fixed angle. As a result, it is inconvenient for the user to operate and reduces the user experience.

SUMMARY

Accordingly, it is necessary to provide an electronic cigarette that can trigger the sensor to work even when the atomizer is connected to the power supply device at different angles.

The technical solution provided in this disclosure to solve the problem is as follows:

an electronic cigarette includes an atomizer, a power supply device detachably connected to the atomizer, and a sensor; the atomizer is provided with a first induction air passage and a first communication hole communicating with the first induction air passage, the power supply device is provided with a second induction air passage and a second communication hole communicating with the second induction air passage; the sensor is accommodated in the second induction air passage, the quantity of either the first communication hole or the second communication hole is set to be at least one, and the quantity of the other one is set to be at least two. When the atomizer is connected at different angles with respect to the power supply device, at least one of the first communication holes is in communication with at least one of the second communication holes to cause the first induction air passage and the second induction air passage to communicate with each other.

Further, the quantity of the first communication hole is one, the quantity of the second communication hole is two, and the two second communication holes are symmetrically distributed about a center.

Further, the quantity of the first communication hole is two, the quantity of the second communication hole is one, and the two first communication holes are symmetrically distributed about a center.

Further, the quantity of the first communication hole is two, the quantity of the second communication hole is two, the two first communication holes are symmetrically distributed about a center, and the two second communication holes are symmetrically distributed about a center.

Further, the atomizer includes a liquid storage member having the first induction air passage and a base provided at one end of the liquid storage member, the power supply device includes a power supply housing having the second induction air passage and an end cover provided at one end of the power supply housing, the first communication hole is provided in the base, the second communication hole is provided in the end cover, and the liquid storage member is detachably connected to the power supply housing, or the base is detachably connected to the end cover.

Further, the first induction air passage is disposed in a sidewall of the liquid storage member, both ends of the first induction air passage passes through the upper and lower end surfaces of the liquid storage member, the base abuts against the lower end surface of the liquid storage member, the first communication hole communicates with the lower open end of the first induction air passage, and the cavity enclosed by the power supply housing and the end cover constitutes the second induction air passage.

Further, the atomizer further includes an upper cover assembly provided at one end of the liquid storage member opposite to the base, a smoke outlet channel spaced from the first induction air passage is further provided in the atomizer, the upper cover assembly includes a mouthpiece sleeved on one end of the liquid storage member, the mouthpiece is provided with a smoking port, and the smoking port is in communication with the smoke outlet channel and the first induction air passage.

Further, the atomizer further includes a base assembly provided at the other end of the liquid storage member opposite to the upper cover assembly, and a vent tube, wherein a liquid storage cavity is provided in the liquid storage member, the base assembly includes the base, the base assembly is provided with an atomizing chamber in communication with the liquid storage cavity, the vent tube is received in the liquid storage cavity, the vent tube is in communication with the atomizing chamber, and the smoke outlet channel is formed by the inner cavity of the vent tube and the atomizing chamber.

Further, a first electrode is mounted on the base, and a second electrode is mounted on the end cover corresponding to the first electrode. When the atomizer is connected to the power supply device, the first electrode is in contact with and electrically connected to the second electrode.

Further, the electronic cigarette further includes a control board, the power supply device is electrically connected to the atomizer, and the control board is electrically connected to the sensor and the power supply device.

The beneficial effects of the disclosure are as follows:

the electronic cigarette provided by the disclosure allows the user to connect the atomizer and the power supply device from different angles, and the first induction air passage is in communication with the second induction air passage to trigger the sensor to start work, user operations are more diversified and user-friendly, which is convenient for the users and improves the user experience.

BRIEF DESCRIPTION OF THE DRAWINGS

Exemplary embodiments of the disclosure are described more fully hereinafter with reference to the accompanying drawings.

Figure 1:
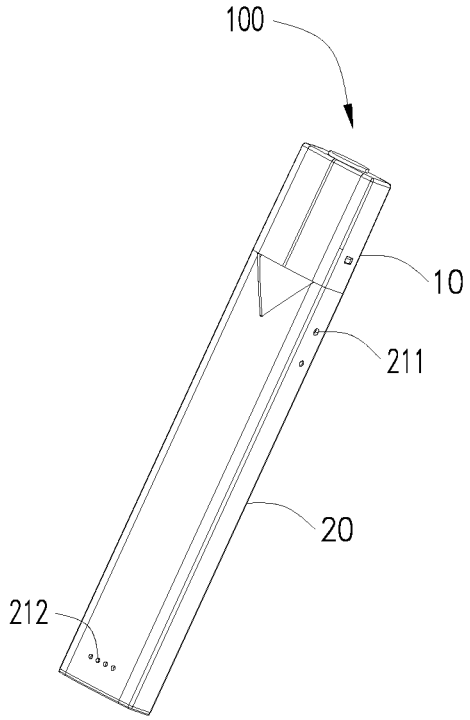
FIG. 1 is a perspective view of an electronic cigarette according to a first embodiment of the present disclosure.

Designations and reference numerals of the parts and components in the drawings are as follows:

| | | |
|---|---|---|
| electronic cigarette 100 | atomizer 10 | liquid storage member 11 |
| liquid storage cavity 111 | liquid injection port 112 | first induction air passage 101 |
| air outlet hole 113 | air inlet hole 114 | base assembly 12 |
| base 121 | first communication hole 1011 | support sleeve 122 |
| air inlet port 1221 | first electrode 123 | atomizing sleeve 124 |
| atomizing chamber 1241 | heating member 125 | sealing member 126 |
| vent tube 14 | upper cover assembly 13 | liquid injection plug 131 |
| sealing plate 1311 | sealing column 1312 | airflow converging cavity 1313 |
| mouthpiece 132 | smoking port 1321 | sealing ring 133 |
| mouthpiece sealing plug 134 | power supply housing 21 | air vent hole 211 |
| second induction air passage 201 | light transmission hole 212 | end cover 22 |
| second communication hole 2011 | power source 23 | second electrode 24 |
| mounting bracket 25 | sensor 30 | control board 40 |
| light guiding assembly 50 | fixing plate 51 | light-emitting element 52 |
| light guiding plate 53 | light shielding sheet 54 | power supply device 20 |

DETAILED DESCRIPTION OF PREFERRED EMBODIMENTS

The disclosure is specifically illustrated with reference to accompanying drawings. The accompanying drawings are schematic views which shows fundamental structures of exemplary embodiments of the disclosure. Thus, merely the constructions related to the disclosure are shown.

First Embodiment

Figure 2:
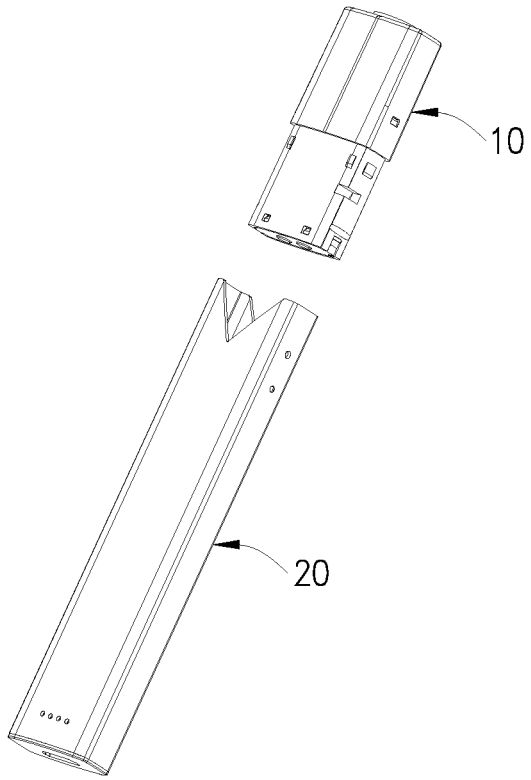
FIG. 2 is an exploded view of the electronic cigarette shown in FIG. 1.

Please referring to FIGS. 1 and 2, the first embodiment of the present disclosure provides an electronic cigarette 100. The electronic cigarette 100 includes an atomizer 10, a power supply device 20 electrically connected to the atomizer 10, and a sensor 30 installed in the power supply device 20. During the user's suction operation, after the sensor 30 senses the change in air pressure, the power supply device 20 starts to supply power to the atomizer 10, so that the atomizer 10 works to atomize the cigarette liquid to generate smoke, and the smoke is for the user to inhale.

Figure 3:
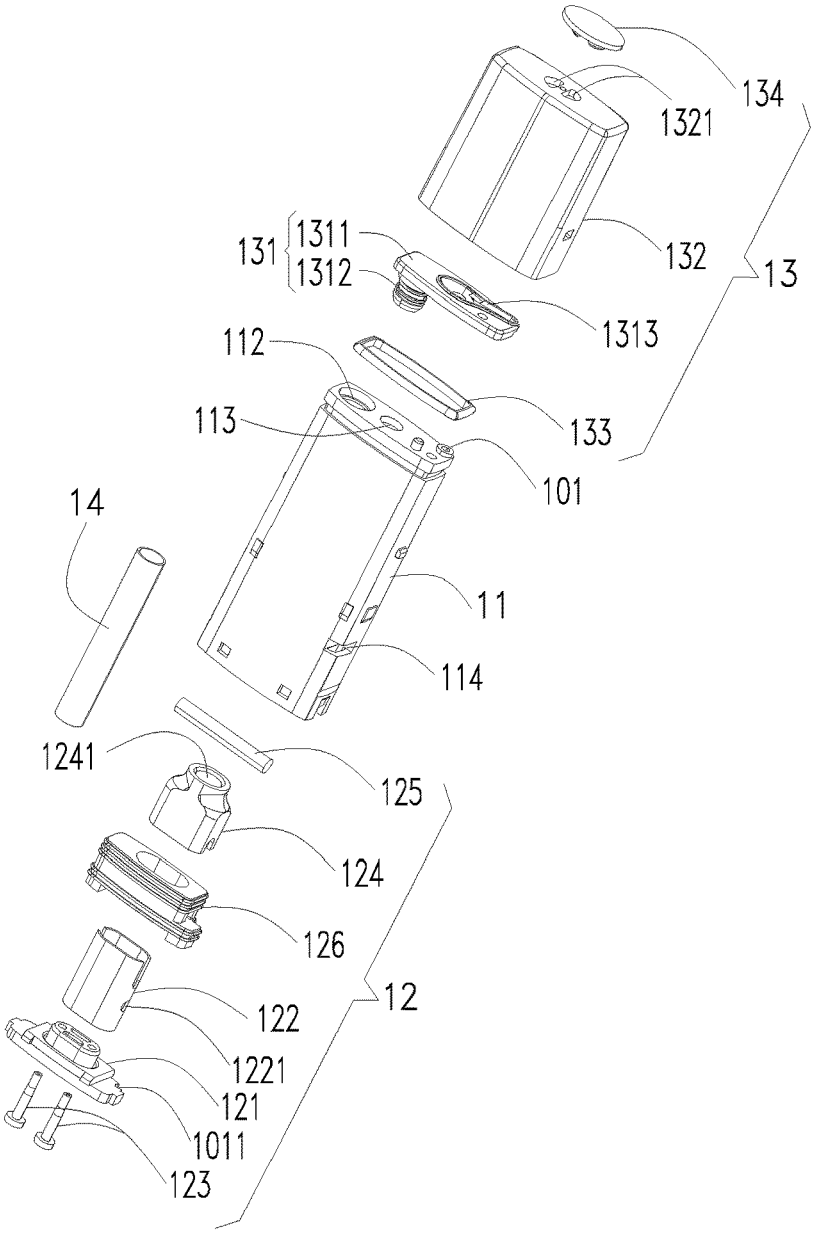
FIG. 3 is an exploded view of an atomizer of the electronic cigarette shown in FIG. 2.
Figure 4:
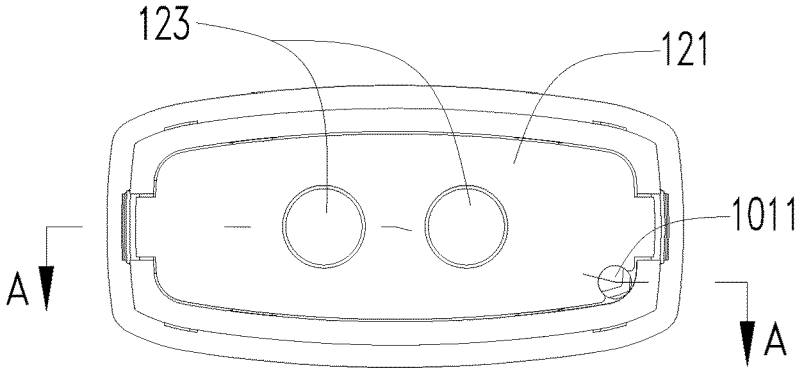
FIG. 4 is a bottom view of the atomizer shown in FIG. 3.
Figure 5:
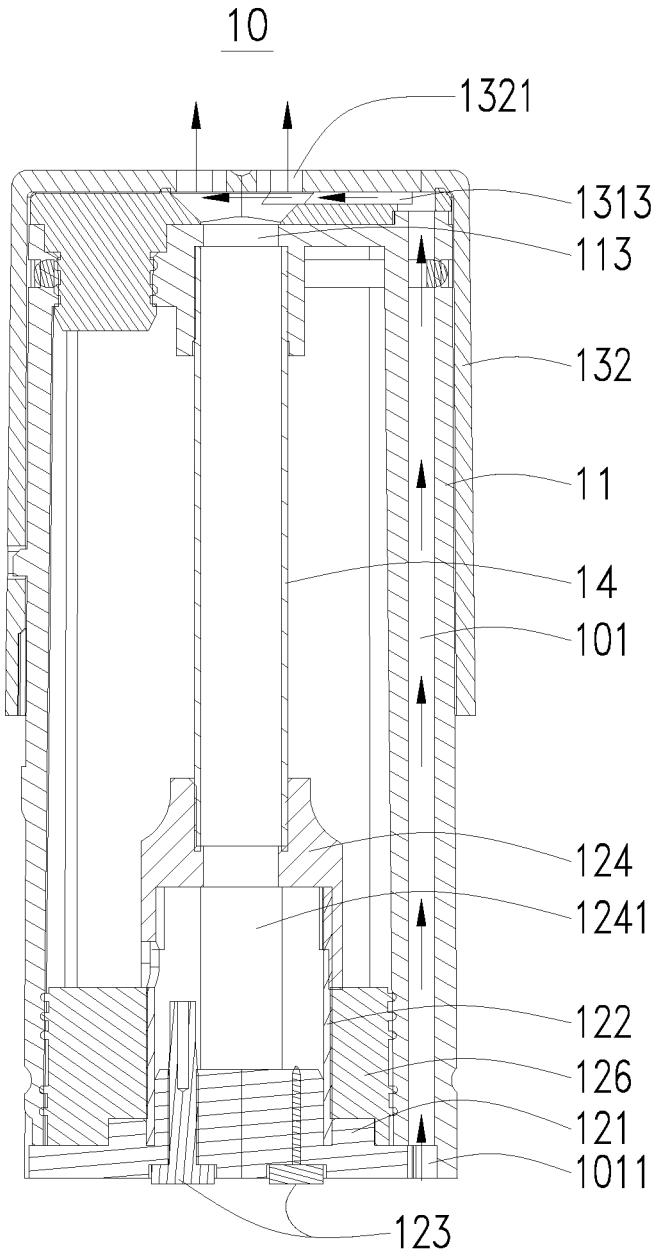
FIG. 5 is a cross-sectional view along A-A in the atomizer shown in FIG. 4.
Figure 6:
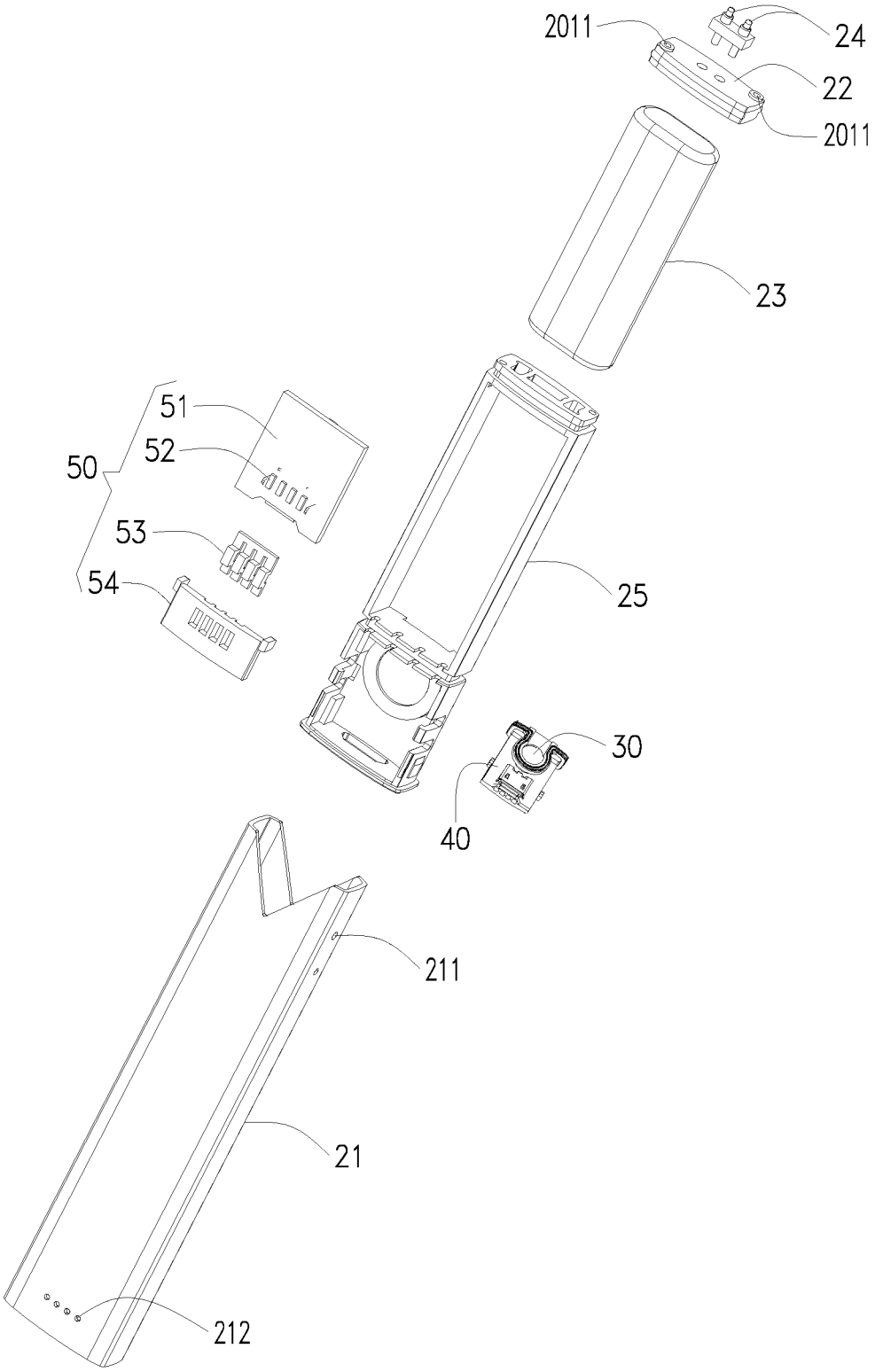
FIG. 6 is an exploded view of a power supply device of the electronic cigarette shown in FIG. 2.
Figure 7:
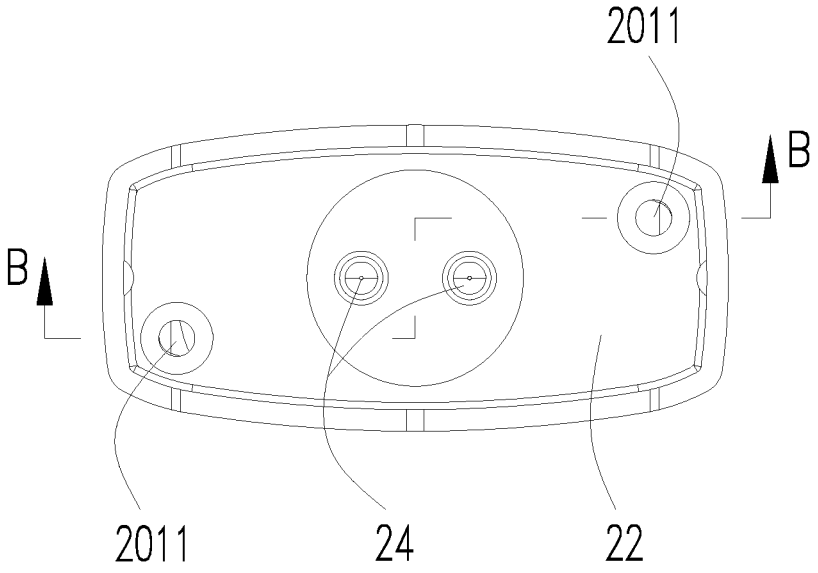
FIG. 7 is a top view of the power source device shown in FIG. 6.
Figure 8:
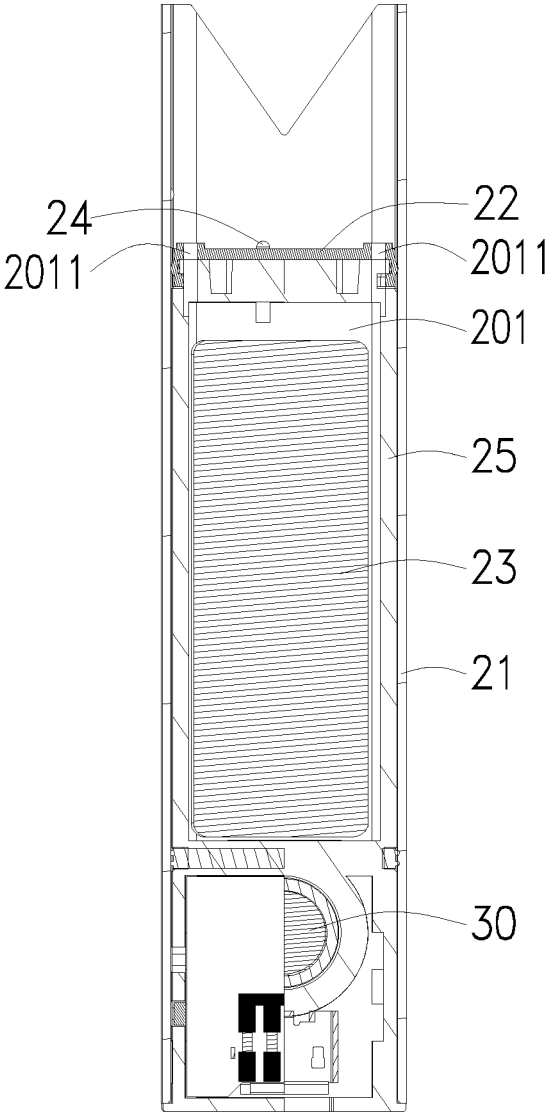
FIG. 8 is a cross-sectional view taken along B-B in the power supply device shown in FIG. 7.

Specifically, referring to FIGS. 3-5, the atomizer 10 includes a liquid storage member 11, a base assembly 12 provided at one end of the liquid storage member 11, an upper cover assembly 13 provided at the other end of the liquid storage member 11 opposite to the base assembly 12, and a vent tube 14 received in the liquid storage member 11.

The liquid storage member 11 is generally a hollow cylindrical structure with an opening at the lower end. The internal space of the liquid storage member 11 forms a liquid storage cavity 111 for storing cigarette liquid. In order to facilitate the user to inject liquid into the liquid storage chamber 111, the upper end of the liquid storage member 11 is provided with a liquid injection port 112 communicating with the liquid storage cavity 111. It can be understood that the liquid storage member 11 is made of a transparent or translucent material, so that the user can observe the remaining amount of cigarette liquid in the liquid storage cavity 111 through the liquid storage member 11, which is convenient for the user to inject liquid in time. In this embodiment, the liquid storage member 11 is made of transparent glass.

A first induction air passage 101 located at one side of the liquid storage cavity 111 is provided in the sidewall of the liquid storage member 11 along the axial direction of the liquid storage member 11. The lower end of the first induction air passage 101 passes through the lower end surface of the liquid storage member 11, and the upper end of the first induction air passage 101 passes through the upper end surface of the liquid storage member 11.

In this embodiment, the upper end of the liquid storage member 11 is further provided with an air outlet hole 113, and the side wall of the liquid storage member 11 is provided with an air inlet hole 114.

The base assembly 12 includes a base 121 installed at the lower end of the liquid storage member 11, a support sleeve 122 and a first electrode 123 respectively mounted on the base 121, an atomizing sleeve 124 sleeved outside of the support sleeve 122, and a heating member 125 mounted at the atomizing sleeve 124.

In this embodiment, the upper end surface of the base 121 abuts against the lower end surface of the liquid storage member 11. The base 121 is provided with a first communication hole 1011 corresponding to the lower open end of the first induction air passage 101 and communicating with the first induction air passage 101. The first electrode 123 includes two first poles (not labelled), and the two first poles are installed at the lower end of the base 121.

The support sleeve 122 is generally a cylindrical structure with both open ends. The support sleeve 122 is mounted at the upper end surface of the base 121. The sidewall of the support sleeve 122 is provided with an air inlet port 1221, and the sidewall of the sealing member 126 is provided with a connection channel (not shown). When the base assembly 12 and the liquid storage member 11 are installed in place, the air inlet port 1221 and the air inlet hole 114 communicate with each other through the connection channel. The atomizing sleeve 124 generally has a cylindrical structure with two open ends. A cavity is formed and surrounded cooperatively by the atomizing sleeve 124 and the supporting sleeve 122, and the cavity constitutes an atomizing chamber 1241. The air inlet port 1221 communicates with the atomizing chamber 1241. The heating member 125 includes a heating element (not shown) and a liquid guiding element (not shown) that are in contact with each other. The heating element is received in the atomizing chamber 1241, and one end of the heating element is electrically connected one of the first poles, and the other end of the heating element is electrically connected to the other first pole. The heating element is sleeved on the outside of the liquid guiding element, two ends of the liquid guiding element pass through the side wall of the atomizing sleeve 124 and extend into the liquid storage cavity 111 to communicate with the liquid storage cavity 111. In use, the liquid guiding member absorbs cigarette liquid from the liquid storage cavity 111, and after the heating element is powered on, the cigarette liquid absorbed on the liquid guiding member is heated, and the cigarette liquid is atomized to generate smoke, and the smoke fills up the atomizing chamber 1241. In this embodiment, the heating element is a heating wire, and the liquid guiding element is made of cotton. It can be understood that, in alternative embodiments not shown, the heating element may also be an element capable of generating heat after being energized, such as a heating tube and a heating plate, and the liquid guiding element may also be made of other materials with the ability to absorb cigarette liquid, such as fiber rope, porous ceramic, or porous graphite.

In this embodiment, both the upper end of the support sleeve 122 and the lower end of the atomizing sleeve 124 are provided with openings (not shown). When the atomizing sleeve 124 is sleeved on the support sleeve 122, the two openings cooperate with each other to form a through hole, an end portion of the liquid guiding member passes through the through hole and extends into the liquid storage cavity 111.

In addition, the base assembly 12 further includes a sealing member 126. The liquid storage cavity 111 is formed by a space surrounded by the liquid storing member 11 and the sealing member 126. The sealing member 126 is connected to the base 121 and is sandwiched between the support sleeve 122 and the liquid storing member 11, which can play a sealing role, to prevent the leakage of the cigarette liquid in the liquid storage cavity 111.

The vent tube 14 is generally a tubular structure with two open ends. The vent tube 14 is received in the liquid storage cavity 111, and the lower end of the vent tube 14 is connected to the atomizing sleeve 124 and communicates with the atomizing chamber 1241. The upper end of the vent tube 14 is connected to the liquid storage member 11 and communicates with the air outlet hole 113. When the user sucks, the smoke generated in the atomizing chamber 1241 enters the user's mouth through the vent tube 14. The inner cavity of the vent tube 14 and the atomizing chamber 1241 together form a smoke outlet channel (not labelled).

The upper cover assembly 13 includes a liquid injection plug 131 mounted on the liquid injection port 112 and a mouthpiece 132 sleeved on the upper end of the liquid storage member 11.

The liquid injection plug 131 includes a sealing plate 1311 and a sealing column 1312 which are integrally formed. The sealing plate 1311 covers on the upper end surface of the liquid storage member 11. The sealing column 1312 protrudes out from the lower end surface of the sealing plate 1311 and is detachably connected with the liquid injection port 112 to seal the liquid injection port 112 and prevent the cigarette liquid from leaking through the liquid injection port 112. It can be understood that the liquid injection plug 131 is made of a sealing material such as silicone or rubber. The sealing plate 1311 is provided with an airflow converging cavity 1313, the airflow converging cavity 1313 is in communication with the air outlet hole 113 and the upper open end of the first induction air passage 101.

The mouthpiece 132 generally has a hollow cylindrical structure with an opening at the lower end. The mouthpiece 132 is engaged with the liquid storage member 11. The liquid injection plug 131 is accommodated in the mouthpiece 132, and the upper end surface of the sealing plate 1311 abuts against the top wall of the mouthpiece 132. A smoking port 1321 is provided at the top of the mouthpiece 132, and the smoking port 1321 is in communication with the airflow converging cavity 1313, so that the smoking port 1321 communicates with the atomizing chamber 1241, when the user sucks, the smoke is inhaled by the user through the smoking port 1321. In addition, in order to improve the air-tightness between the mouthpiece 132 and the liquid storage member 11, a sealing ring 133 is sandwiched between the inner wall of the mouthpiece 132 and the outer wall of the liquid storage member 11 to prevent air leakage. It can be understood that the sealing ring 133 is made of a sealing material such as silicone or rubber.

It can be understood that, in other embodiments not shown, the liquid injection plug 131 may include only the sealing column 1312, that is, the sealing plate 1311 and the airflow converging cavity 1313 provided thereon are omitted, so long as and only the smoking on the mouthpiece 132 needs to be satisfied. The smoking port 1321 of the mouthpiece 132 communicates with both the air outlet hole 113 and the upper open end of the first induction air passage 101.

In addition, the upper cover assembly 13 further includes a mouthpiece sealing plug 134, which is detachably mounted in the smoking port 1321. When the user sucks, the mouthpiece sealing plug 134 must be removed before the suction operation can be performed. On the one hand, it can prevent bacteria from entering the electronic cigarette 100 through the smoking port 1321, at the same time, it can also play a safety protection function for children. It can be understood that the mouthpiece sealing plug 134 is made of a sealing material such as silicone or rubber.

Please referring to FIGS. 6-9, the power supply device 20 includes a power supply housing 21, an end cover 22 installed on one end of the power supply housing 21, a power source 23 received in the power supply housing 21, and a second electrode 24 installed on the end cover 22.

The power supply housing 21 is generally a hollow cylindrical structure with an opening at an upper end. The upper end of the power supply housing 21 is at least partially detachably sleeved on the outside of the atomizer 10. In this embodiment, the power supply housing 21 is snap-connected to the liquid storage member 11. It can be understood that, after the liquid storage member 11 and the power supply housing 21 are installed in place, the atomizer 10 and the power supply device 20 are installed in place. It can also be understood that, in other embodiments not shown, the atomizer 10 and the power supply device 20 may also be connected through a detachable connection between the base 121 and the end cover 22, for example, a snap connection, a magnetic connection, or the like. In addition, the sidewall of the power supply housing 21 is provided with an air vent hole 211 corresponding to the air inlet hole 114. When the power supply housing 21 is connected to the atomizer 10, the air vent hole 211 is in communication with the air inlet hole 114 to facilitate external air entering the atomizer 10 through the air vent hole 211. The end cover 22 has a rectangular shape and is installed in the power supply housing 21, and the end cover 22 is perpendicular to the axis of the power supply housing 21. The internal space surrounded by the power supply housing 21 and the end cover 22 forms a second induction air passage 201, and the power source 23 and the sensor 30 are both received in the second induction air passage 201. The second electrode 24 includes two second poles (not labelled). The two second poles are installed on the upper end of the end cover 22, and the two second poles are respectively electrically connected to the positive and negative poles of the power source 23. The second poles has a one-to-one correspondence with the first poles, when the atomizer 10 is connected to the power supply device 20, one of the second poles is in contact with and electrically connected to one of the first poles, and the other second pole is in contact with and electrically connected to the other first pole, so as to achieve the electrical connection between the heating element of the atomizer 10 and the power supply device 20.

In order to facilitate the installation of the power source 23 and the sensor 30, the power supply device 20 further includes a mounting bracket 25 received in the second induction air passage 201, and the power source 23 and the sensor 30 can be detachably mounted on the mounting bracket 25. It can be understood that, in other embodiments not shown, the mounting bracket 25 may be omitted. At this time, the power source 23 and the sensor 30 may be detachably mounted on the inner wall of the second induction air passage 201.

Figure 9:
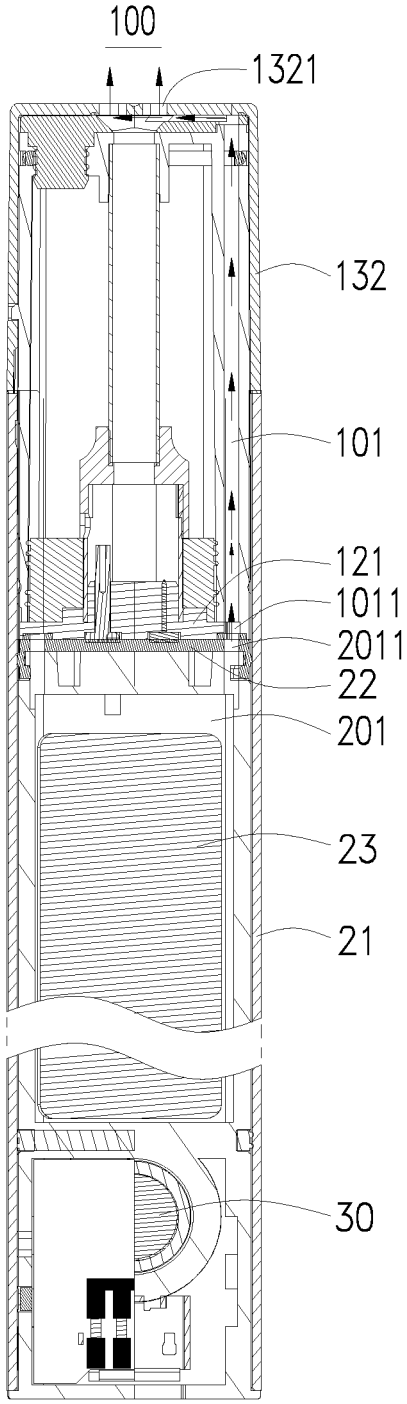
FIG. 9 is a cross-sectional view of the electronic cigarette shown in FIG. 1.
Figure 10:
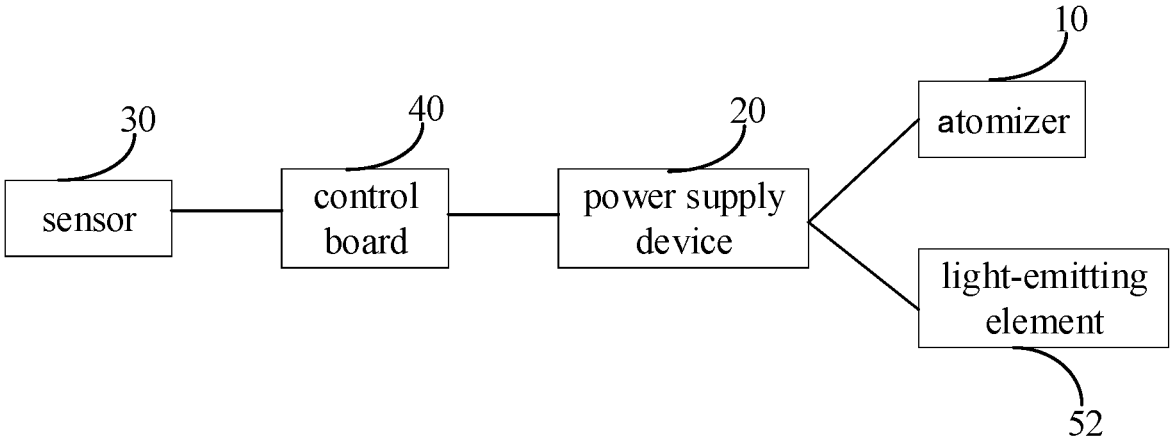
FIG. 10 is a block diagram of the electronic cigarette shown in FIG. 1.

The end cover 22 is provided with a second communication hole 2011 communicating with the second induction air passage 201. The second communication hole 2011 corresponds to the first communication hole 1011. When the atomizer 10 is connected to the power supply device 20, the first communication hole 1011 is in communication with the second communication hole 2011, so that the first induction air passage 101 and the second induction air passage 201 communicate with each other. In addition, please referring to FIG. 10 at the same time, the electronic cigarette 100 of the present disclosure further includes a control board 40. The control board 40 is electrically connected to the sensor 30 and the power supply device 20. When the user sucks, a negative pressure is formed in the first induction air passage 101 and the second induction air passage 201. The sensor 30 generates a pressure difference signal after sensing the pressure change, and transmits the pressure difference signal to the control board 40. After the control board 40 receives the pressure difference signal, it controls the power supply device 20 to supply power to the atomizer 10, thus the cigarette liquid is atomized to generate smoke; and at the same time, the external air enters the atomizing chamber 1241 through the air vent hole 211, the air inlet hole 114 and the air inlet port 1221 in sequence to form a mixed gas with the smoke. Under the action of suction, the mixed gas finally enters the user's mouth through the air vent 14 and the smoking port 1321. The direction indicated by arrows in FIG. 9 is the airflow direction.

In this embodiment, the sensor 30 is an air pressure sensor. It can be understood that, in other embodiments not shown, the sensor 30 may also be an airflow sensor. Specifically, the power supply device 20 is provided with an air vent opening communicating with the second induction air passage 201. When the user performs a suction operation, the airflow in the second induction air passage 201 passes through the airflow sensor, and the airflow sensor senses the airflow change and generates an airflow signal accordingly. After the airflow signal is transmitted to the control board 40, the control board 40 controls the power supply device 20 to supply power to the atomizer 10.

Please referring to FIGS. 6 and 10 again, the electronic cigarette 100 of the present disclosure further includes a light guiding assembly 50 received in the second induction air passage 201. The light guiding assembly 50 includes a fixing plate 51 mounted on the mounting bracket 25, a light-emitting element 52 mounted on the fixing plate 51, a light guiding plate 53 covered on the light-emitting element 52, and a light shielding sheet 54 installed on the fixing plate 51. The light guiding plate 53 has a protruding portion covering the light-emitting element 52, and the protruding portion of the light guiding plate 53 passes through the light shielding sheet 54. The light-emitting element 52 is electrically connected to the power supply device 20. When the control board 40 controls the power supply device 20 to supply power to the atomizer 10, the control board 40 also controls the power supply device 20 to supply power to the light-emitting element 52, so that the light-emitting element 52 works to emit light. In this embodiment, the light emitting element 52 is an LED lamp. The light guiding plate 53 is made of silicone or rubber material, so that the light emitted by the light-emitting element 52 is weakened after passing through the light guiding plate 53 so as not to be dazzling. In addition, the light shielding sheet 54 can prevent light from passing through the side of the light emitting element 52. A light transmission hole 212 corresponding to the light emitting element 52 is provided on the sidewall of the power supply housing 21, and the light emitted by the light emitting element 52 can be perceived by the user through the light transmission hole 212. Therefore, when the user performs a smoking operation, the light-emitting element 52 is turned on and emits light, which can provide the user with a smoking situation of the electronic cigarette 100. At the same time, the playability of the electronic cigarette 100 can be enhanced, thereby improving the user experience.

Please referring to FIG. 7 again, in this embodiment, there are two second communication holes 2011, and the two second communication holes 2011 are symmetrically distributed about the axis of the end cover 22. When the atomizer 10 is connected to the power supply device 20 at an angle, the first communication hole 1011 communicates with one of the second communication holes 2011, and the other second communication hole 2011 is sealed by the base 121. At this time, the first induction air passage 101 is in communication with the second induction air passage 201, and the sensor 30 can be triggered to work when the user performs a suction operation. When the user connects the atomizer 10 with the power supply device 20 after the atomizer 10 is rotated 180° relative to the power supply device 20, the second communication hole 2011 previously connected to the first communication hole 1011 is sealed by the base 121, and the second communication hole 2011 previously sealed by the base 121 is in communication with the first communication hole 1011. At this time, the first induction air passage 101 and the second induction air passage 201 are still in communication with each other, and the user 30 can also trigger the sensor 30 to work during the suction operation.

It can be understood that, in other embodiments not shown, there are a plurality of second communication holes 2011, and the plurality of second communication holes 2011 are distributed on a circle with the center of the end cover 22 as the center of the circle. By rotating the atomizer 10 relative to the end cover 22, the first communication hole 1011 can be aligned and communicated with any one of the second communication holes 2011, so that the first induction air passage 101 and the second induction air passage 201 communicate with each other, and the sensor 30 is triggered to work when the user performs a suction operation.

Therefore, in the electronic cigarette 100 provided by the present disclosure, the user can connect the atomizer 10 and the power supply device 20 from different angles to cause the first induction air passage 101 and the second induction air passage 201 to communicate with each other to trigger the sensor 30 to work, user operations are more diverse and user-friendly, which is convenient for the users and improves the user experience.

Second Embodiment

The difference between the electronic cigarette provided in the second embodiment of the present disclosure and the electronic cigarette 100 in the first embodiment is as follows: the base 121 is provided with two first communication holes 1011, the two first communicating holes 1011 are distributed symmetrically about the axis of the base 121, and the end cover 22 is provided with only one second communication hole 2011 corresponding to the first communication holes 1011.

When the atomizer 10 is connected to the power supply device 20 at an angle, the second communication hole 2011 communicates with one of the first communication holes 1011, so that the first induction air passage 101 and the second induction air passage 201 communicate with each other, and when the user sucks, the sensor 30 can be triggered to work. When the user connects the atomizer 10 with the power supply device 20 after the atomizer 10 is rotated 180° relative to the power supply device 20, the second communication hole 2011 is in communication with the other first communication hole 1011. At this time, the first induction air passage 101 and the first two second induction air passages 201 are still in communication with each other, and it can also trigger the sensor 30 to work when the user sucks.

In addition, a sealing pad is provided on the upper end of the end cover 22, wherein the sealing pad and the second communication hole 2011 are symmetrically distributed about the axis of the end cover 22. Therefore, when the second communication hole 2011 communicates with one of the first communication holes 1011, the sealing pad seals the other first communication hole 1011, thereby preventing airflow from flowing through the two first communication holes 1011 at the same time to affect the sensitivity of the sensor 30. It can be understood that there are a plurality of the first communication holes 1011, and correspondingly, there are also a plurality of the sealing pads. When the atomizer 10 is installed at different angles, it is required that only one of the first communication hole 1011 is in communication with the second communication hole 2011.

Third Embodiment

The difference between the electronic cigarette provided in the third embodiment of the present disclosure and the electronic cigarette 100 of the first embodiment is as follows: in this embodiment, the base 121 is provided with two first communication holes 1011, the two first communicating holes 1011 are distributed symmetrically about the axis of the base 121, the end cover 22 is provided with two second communication holes 2011, and the two second communication holes 2011 are symmetrically distributed about the axis of the end cover 22. Therefore, when the atomizer 10 is connected to the power supply device 20, one of the first communication holes 1011 is always in communication with one of the second communication holes 2011, so that the first induction air passage 101 and the second induction air passage 201 are always in communication with each other. In this way, the sensor 30 is triggered when the user sucks. It can be understood that, the quantity of the first communication hole 1011 and the second communication hole 2011 can be multiple, it only needs to satisfy that when the atomizer 10 is connected to the power supply device 20, each first communication hole 1011 can communicate with one of the second communication holes 2011, and there is no limitation on the arrangement of the first communication hole 1011 and the second communication hole 2011.

The embodiments described above are merely preferred embodiments, but not intended to limit the present disclosure. Any modifications, alternatives or improvements made within the principle and spirit of the present disclosure should be interpreted as falling within the protection scope of the present disclosure. The protection scope are not limited to the content described above. Rather, the protection scope of the disclosure is defined by the appended claims.

What is claimed is:

1. An electronic cigarette comprising an atomizer, a power supply device detachably connected to the atomizer, and a sensor, wherein the atomizer is provided with a smoke outlet channel arranged along a central axis of the atomizer, a first induction air passage arranged offset from the central axis of the atomizer and located at one side of the smoke outlet channel, and a first communication hole communicating with the first induction air passage, both the smoke outlet channel and the first induction air passage extend along an axial direction of the atomizer, and the first induction air passage is isolated from the smoke outlet channel; the power supply device is provided with a second induction air passage and a second communication hole communicating with the second induction air passage; the sensor is accommodated in the second induction air passage, the quantity of either the first communication hole or the second communication hole is set to be at least one, and the quantity of the other one is set to be at least two; when the atomizer is connected at different angles with respect to the power supply device, at least one of the first communication holes is in communication with at least one of the second communication holes to cause the first induction air passage and the second induction air passage to communicate with each other.

2. The electronic cigarette according to claim 1, wherein the quantity of the first communication hole is one, the quantity of the second communication hole is two, and the two second communication holes are symmetrically distributed about a center.

3. The electronic cigarette according to claim 1, wherein the quantity of the first communication hole is two, the quantity of the second communication hole is one, and the two first communication holes are symmetrically distributed about a center.

4. The electronic cigarette according to claim 1, wherein the quantity of the first communication hole is two, the quantity of the second communication hole is two, the two first communication holes are symmetrically distributed about a center, and the two second communication holes are symmetrically distributed about a center.

5. The electronic cigarette according to claim 1, wherein the electronic cigarette further comprises a control board, the power supply device is electrically connected to the atomizer, and the control board is electrically connected to the sensor and the power supply device.

6. The electronic cigarette according to claim 1, wherein the atomizer comprises a liquid storage member having the first induction air passage and a base provided at one end of the liquid storage member, the power supply device comprises a power supply housing having the second induction air passage and an end cover provided at one end of the power supply housing, the first communication hole is provided in the base, the second communication hole is provided in the end cover, the liquid storage member is detachably connected to the power supply housing, or the base is detachably connected to the end cover.

7. The electronic cigarette according to claim 6, wherein the first induction air passage is disposed in a sidewall of the liquid storage member, both ends of the first induction air passage respectively passes through the upper and lower end surfaces of the liquid storage member, the base abuts against the lower end surface of the liquid storage member, the first communication hole communicates with the lower open end of the first induction air passage, and the cavity enclosed by the power supply housing and the end cover constitutes the second induction air passage.

8. The electronic cigarette according to claim 6, wherein a first electrode is mounted on the base, a second electrode is mounted on the end cover corresponding to the first electrode, when the atomizer is connected to the power supply device, the first electrode is in contact with and electrically connected to the second electrode.

9. The electronic cigarette according to claim 6, wherein the base is installed at a lower end of the liquid storage member, and the base is arranged perpendicularly to the axial direction of the atomizer, the first communication hole passes through the base along the axial direction of the atomizer;

the end cover is installed at an upper end of the power supply housing, and the end cover is arranged perpendicularly to the axial direction of the atomizer, the second communication hole passes through the end cover along the axial direction of the atomizer;

when the atomizer is connected to the power supply device, an upper end surface of the end cover abuts against a lower end surface of the base;

wherein the second communication hole and the first communication hole are aligned and communicated to each other along the axial direction of the atomizer;

wherein the first communication hole and the first induction air passage are aligned and communicated to each other along the axial direction of the atomizer.

10. The electronic cigarette according to claim 6, wherein the atomizer is provided with an atomizing chamber, a sidewall of the liquid storage member is provided with an air inlet hole, a sidewall of the power supply housing is provided with an air vent hole corresponding to the air inlet hole, and the external air enters the atomizing chamber through the air vent hole and the air inlet hole.

11. The electronic cigarette according to claim 6, wherein the atomizer further comprises an upper cover assembly provided at one end of the liquid storage member opposite to the base, the upper cover assembly comprises a mouthpiece sleeved on one end of the liquid storage member, the mouthpiece is provided with a smoking port, and the smoking port is in communication with the smoke outlet channel and the first induction air passage.

12. The electronic cigarette according to claim 11, wherein the atomizer further comprises a base assembly provided at the other end of the liquid storage member opposite to the upper cover assembly, and a vent tube, wherein a liquid storage cavity is provided in the liquid storage member, the base assembly comprises the base, the base assembly is provided with an atomizing chamber in communication with the liquid storage cavity, the vent tube is received in the liquid storage cavity, the vent tube is in communication with the atomizing chamber, and the smoke outlet channel is formed by the inner cavity of the vent tube and the atomizing chamber.

13. The electronic cigarette according to claim 6, wherein an internal space of the liquid storage member forms a liquid storage cavity for storing cigarette liquid, a vent tube configured to form the smoke outlet channel is received in the liquid storage cavity, the vent tube extends along the central axis of the atomizer, the liquid storage cavity is formed around the vent tube, the first induction air passage is provided in a sidewall of the liquid storage member, and the first induction air passage is separated from the vent tube through the liquid storage cavity.

14. The electronic cigarette according to claim 13, wherein the first induction air passage and the smoke outlet channel are parallel to each other along the axial direction of the atomizer, and the first induction air passage and the smoke outlet channel are spaced apart from each other along a radial direction of the atomizer through the liquid storage cavity.

* * * * *